US006722381B2

(12) United States Patent
Lai

(10) Patent No.: US 6,722,381 B2
(45) Date of Patent: Apr. 20, 2004

(54) MECHANISM FOR UMBRELLA SELF LOCK OPERATION

(76) Inventor: Jin Sheng Lai, PO Box 82-144, Taipei (TW)

( * ) Notice: Subject to any disclaimer, the term of this patent is extended or adjusted under 35 U.S.C. 154(b) by 0 days.

(21) Appl. No.: 10/216,758

(22) Filed: Aug. 13, 2002

(65) Prior Publication Data

US 2003/0234033 A1 Dec. 25, 2003

(30) Foreign Application Priority Data

Jun. 19, 2002 (TW) ..... 91209176 U

(51) Int. Cl.[7] ..... A45B 25/14; B65H 75/26

(52) U.S. Cl. ..... 135/20.3; 135/98; 242/394; 242/395

(58) Field of Search ..... 135/98, 20.1, 20.3, 135/25.4; 242/394, 395, 396.1, 396.5, 306

(56) References Cited

U.S. PATENT DOCUMENTS 2,914,154 A * 11/1959 Russell ..... 135/20.3
3,410,285 A * 11/1968 Small ..... 135/20.3
4,386,621 A * 6/1983 Redl ..... 135/20.3
4,622,987 A * 11/1986 Redl et al. ..... 135/20.3
5,437,297 A * 8/1995 Crisman et al. ..... 135/20.1
5,884,859 A * 3/1999 Ma ..... 242/395
6,182,917 B1 * 2/2001 Lai ..... 242/390.8
6,196,242 B1 * 3/2001 Xu ..... 135/20.1
6,196,489 B1 * 3/2001 Ma ..... 242/396.2
6,230,724 B1 * 5/2001 Lai ..... 135/20.3
6,591,848 B2 * 7/2003 Ma ..... 135/22

* cited by examiner

*Primary Examiner*—Winnie S. Yip
(74) *Attorney, Agent, or Firm*—Leong C. Lei

(57) ABSTRACT

This invention is for a type of mechanism for umbrella self lock operation. It is composed of the swinging mechanism, lifting mechanism, stopping mechanism and clutch mechanism. Among them, the clutch mechanism includes a spooler with a hole in the middle section for rope to pass through. On the axial, there are stopper rings and elastic flexible keys. The front end of the spooler has screw thread section. The clutch axle box shall have ratchet and the on the ring diameter, there is positioning threads. It enters through the front-end thread section of the spooler. It will make the ratchet section and the elastic flexible keys joint together under normal conditions. Through handgrip thread, it joints together with the front-end thread section of the spooler. It will control the left and right rotating movement. Use pressure to engage the joint of axle box and the thread of the front cover, it forms auto self lock performance. During reverse rotation, it will separate the joint of axle box and the thread of the front cover. It then achieves the umbrella closing and folding function.

6 Claims, 9 Drawing Sheets

MECHANISM FOR UMBRELLA SELF LOCK OPERATION

BACKGROUND OF THE INVENTION

1. Field of the Invention

This invention is related to a mechanism for umbrella self lock operation.

2. Description of the Prior Art

Umbrella is the necessary fixture for traveling, dinning and outdoor recreation etc. In the recent years, due to the richness in shape and the improvement in the feeling quality, umbrella is evolved from the simple tool for shading against the sun and rain and is then transferred to use as internal decoration and art pieces. It is becoming to be the favor items used in outdoor and indoor decoration.

The traditional umbrella consists of surface, pole, seat and coil winding operation mechanism. In general, it only has simple winding open and close function.

But, as the sun rises, it will move from east to west. The result is that after the umbrella is opened and maintained straight up, it may shade some sunlight. But, it could not shade against any sunrays coming from oblique angles. Therefore, for any angling sunrays, the traditional umbrella could not swing the shading angle for effective shading. Therefore, it is necessary to design a shading angle movement mechanism for large umbrella, to provide solution for the umbrella shading angle change problem.

Please refer to FIG. 8. It is a sectional drawing for the traditional umbrella post folding mechanism. It consists of an upper structure, 50, and a lower structure, 60. The center of the upper structure, 50, has a keyhole, 51. And, at the back of the upper structure's end plate, 52, there is a key trough. The lower structure, 60, has a cartridge trough, 61, a push button trough 62 with key thread 63 and spring insert trough 64. After the spring 65 enters the spring trough 64, it will embed the push button 62 into the lower structure 60's trough hole 66. It will also place the upper structure 50 into the lower structure 60's cartridge trough 61, through a pin body 67 passes through the key hole 51 and locks on with nut 68 to form the joint. To change the shading angle of the umbrella, it pushes in the push button 62 to fold the post connecting the upper structure 50 and the top of the umbrella. This will make a suitable angle to block off oblique sunrays.

But, in the traditional angle change mechanism, the operation procedure to move the umbrella is very inconvenient to the user. The open and close of the umbrella uses hand to control the handle of the coil winding mechanism. To change the shading angle of the umbrella, it also requires the use of push button operation. Furthermore, to change and move the shading angle, it also requires the changing of the position of push button. And, the angle changing mechanism is normally located at a higher position. Hand utilization is also required to push and unlock. The other hand is also needed to hold and move the upper umbrella post. The use of two hands at the same time is difficult to coordinate and requires the use of lots of force. It is a very difficult operation.

SUMMARY OF THE INVENTION

This invention is related to a mechanism for umbrella self lock operation.

The main purpose of this invention is to provide an umbrella self lock operation mechanism. It will simplify the operation mechanism to open and close umbrella. The shading angle change mechanism is the same as the open and close mechanism as described before. This is to make it convenient for general users to use hand control.

The secondary purpose of this invention is to provide an umbrella self-locking operation mechanism. It has a self-lock mechanism to prevent the umbrella closing due to strong wind. It also will prevent umbrella blow out from happening.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
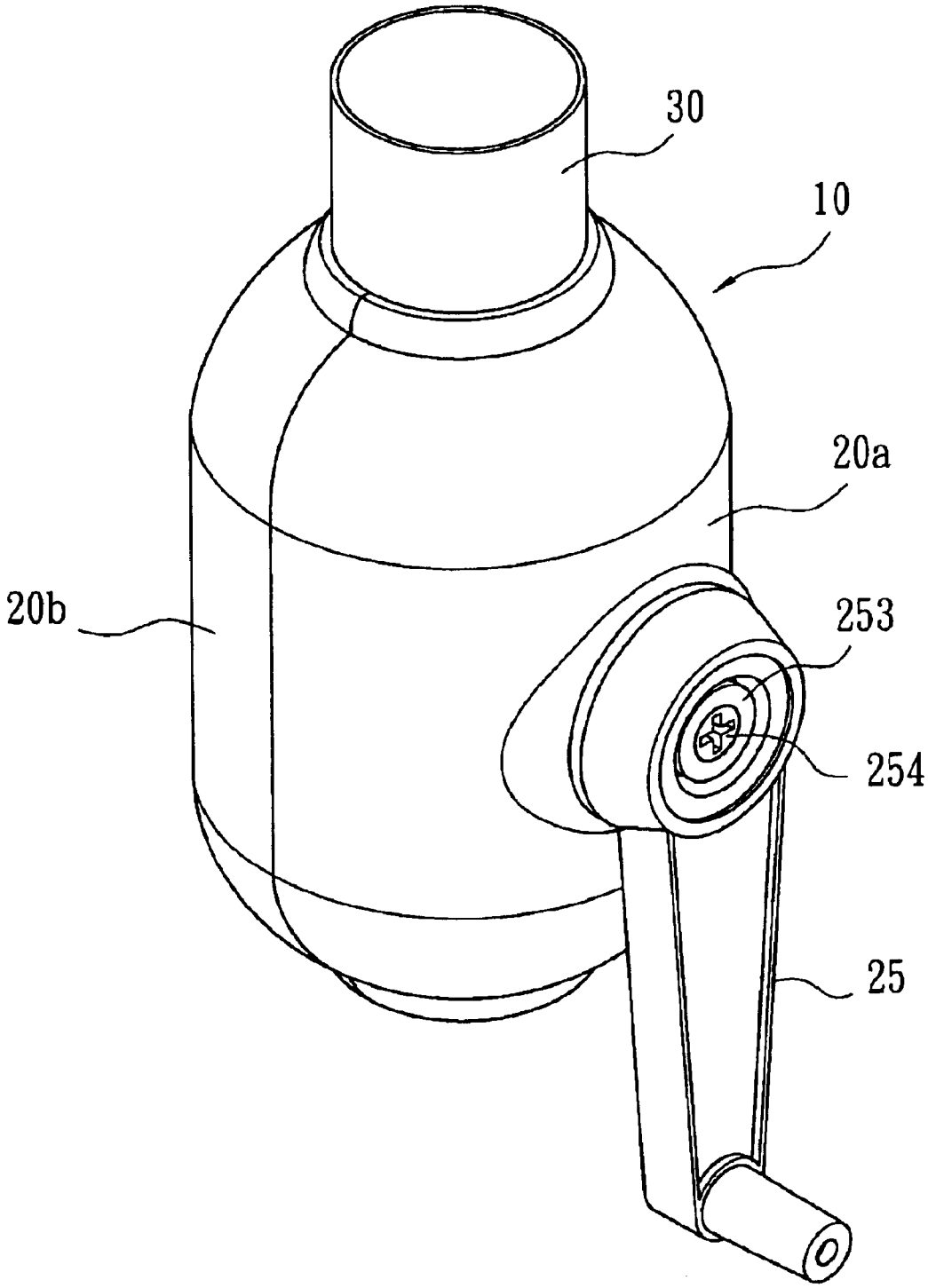
FIG. 1 is the outside appearance diagram of the coil winding mechanism sample.
Figure 2:
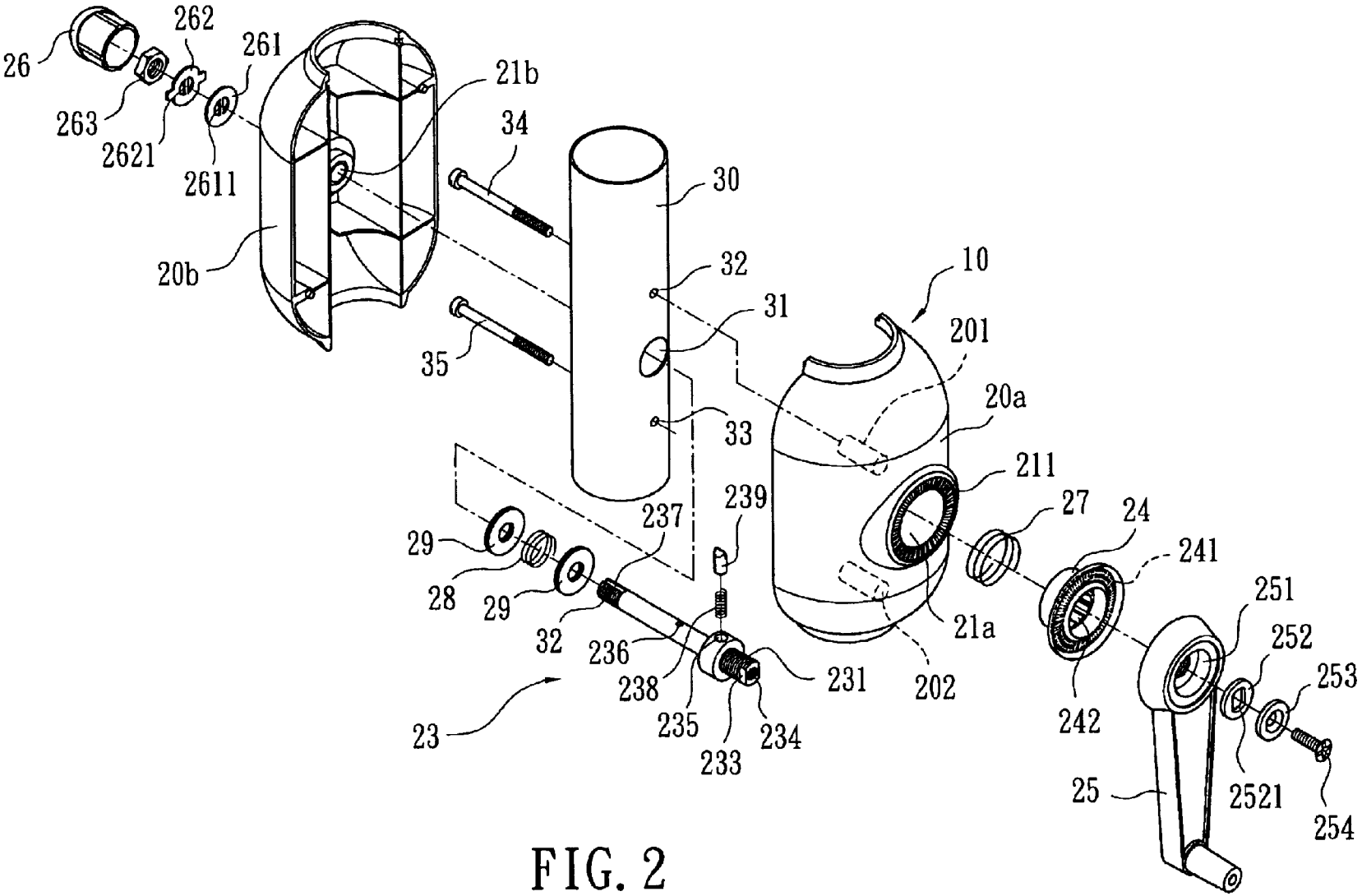
FIG. 2 is the sectional diagram of the sample for this invention.
Figure 3:
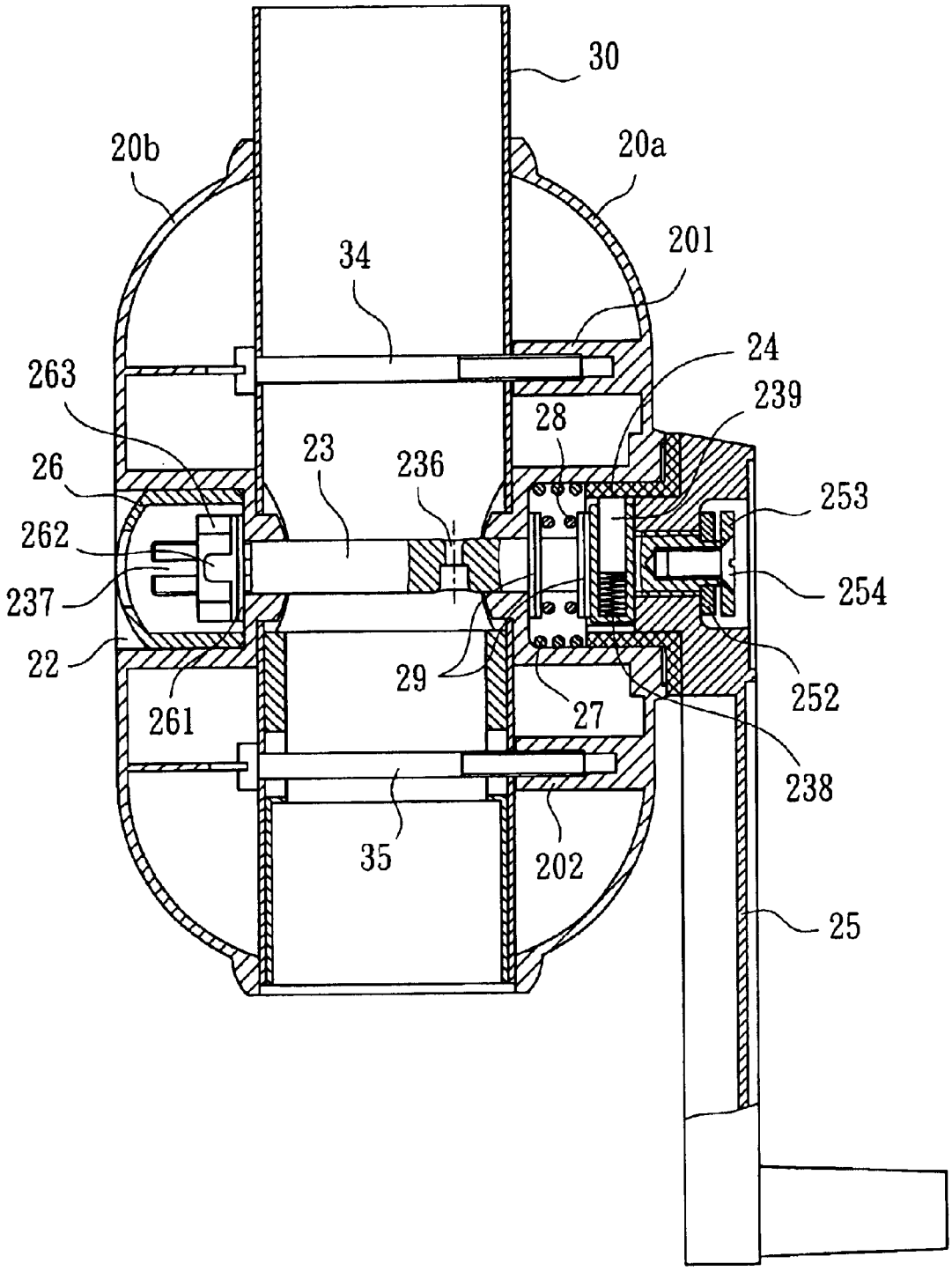
FIG. 3 is the cross sectional diagram of sample for this invention.
Figure 3A:
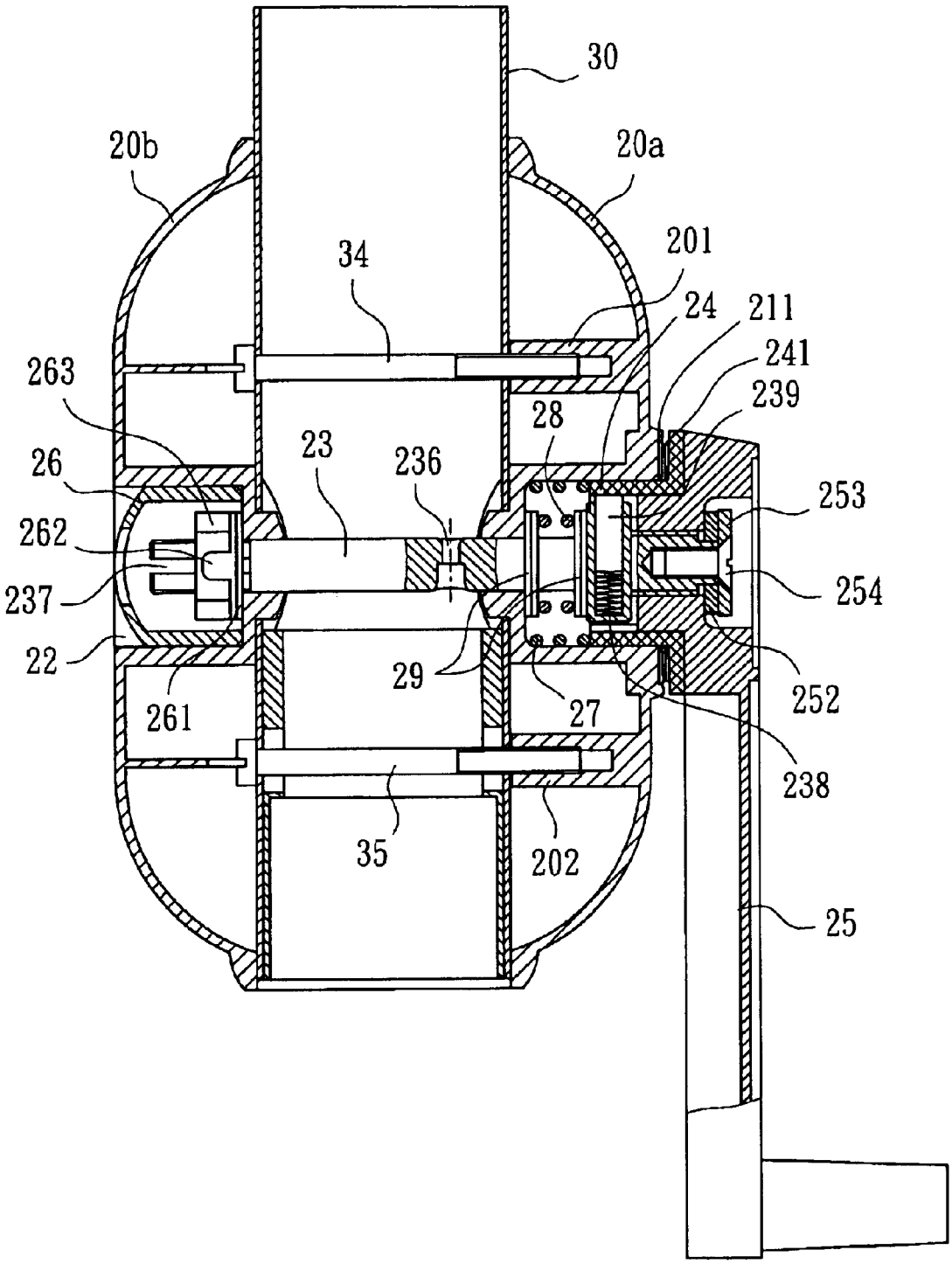
FIG. 3*a* is the cross sectional diagram of sample for this invention, it shows the clutch axle box while rotating by hand, a sketch also shows the disengagement of the axle set from the out cover thread.

As shown in FIGS. 1–3, umbrella self lock mechanism 10 sample of this invention. It consists of a front cover 20*a*, a rear cover 20*b*, combining to form the coil winding mechanism shell. It is installed on an umbrella post 30 at proper height.

The front cover 20 of the sample has an opening 21*a*. It expands from the opening to a trough on the axis and has a thread 211. The two bolt hole columns 201 and 202 are inside the front cover. One side of the rear cover 20*b*has an opening 21*b*; an umbrella post 30 has a through hole 31. At the upper and lower there are bolt holes 32 and 33. Through bolts 34 and 35 pass into holes 32 and 33. They then are fixed on the bolt hole columns 201 and 202.

One end of the spooler 23, there is an expanded baffle ring. On one side, there is the screw-threaded section 231. At the end section, there is the screw thread section 232. On the screw thread section 231, there is a milled surface 233. Bolt hole 234 is located at the axis's end face. A blank hole 235 is axial wisely installed on the aforementioned stop ring. It is used by rope to pass through the rope tie hole 236, locate at the middle of the spooler 23. The milling trough 237 is located at the end screw thread section 232. A spring 238 inserts into the blank hole 235. It is used to perform the flexible push function, when key pin 239 is push in.

Henceforth, after insert the spooler 23 into the front end screw thread section 231 through the opening 21*a* of the front cover 20*a*, the expanding stop ring stops at the thread part 242 location of the clutch axle box 24. At the same time, the key lock 239 will fit into the thread part 242. And on one of the rings of the clutch cover 24, there is a positioning thread 241. After inserted with a spring 27, the positioning thread 241 and opening 21*a* circumference thread 211 will fit and join. This is to prevent axle box 24 from rotating.

At the handgrip 25 center hole 251, there are screw threads. They will fit against spooler 23's front-end section 231. And, use the same milled surface axial post cross section's internal hole 2521 shape stopper washer 232 and sink washer 253, they are installed on the axis. The end uses sink head 254 to screw into the bolt hole 234 for lock fixing.

The spooler 23 end screw thread 232, after pass through two stop plates 29 and one spring 28, they then pass into the umbrella post 30's through hole 31 and rear cover 20*b* opening 21*b*. They then pass through the spooler 23 end screw thread section 232, through washer 2612, stop washer 262, and then use their center keyhole 261 and 2621 to enter into spooler 23 end milling trough 237.

Finally, they are tightened with anti loose nut 263. This arrangement will make the spooler 23 posses suitable rotation angle torque stop force. At the rear cover 20*b* opening 221*b* outside trough 22, it uses a set of cover to achieve good decoration for outlook appearance.

Figure 4:
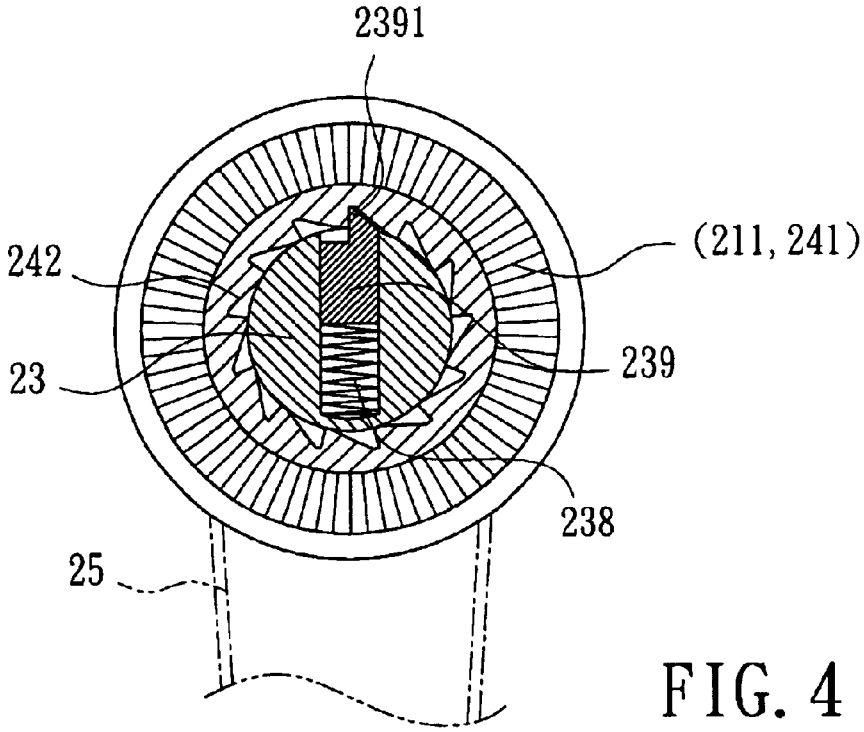
FIG. 4 is cross sectional diagram, shows the lock joint between the key lock and ratchet. It is a sketch, which shows that umbrella is in self-lock status.
Figure 4A:
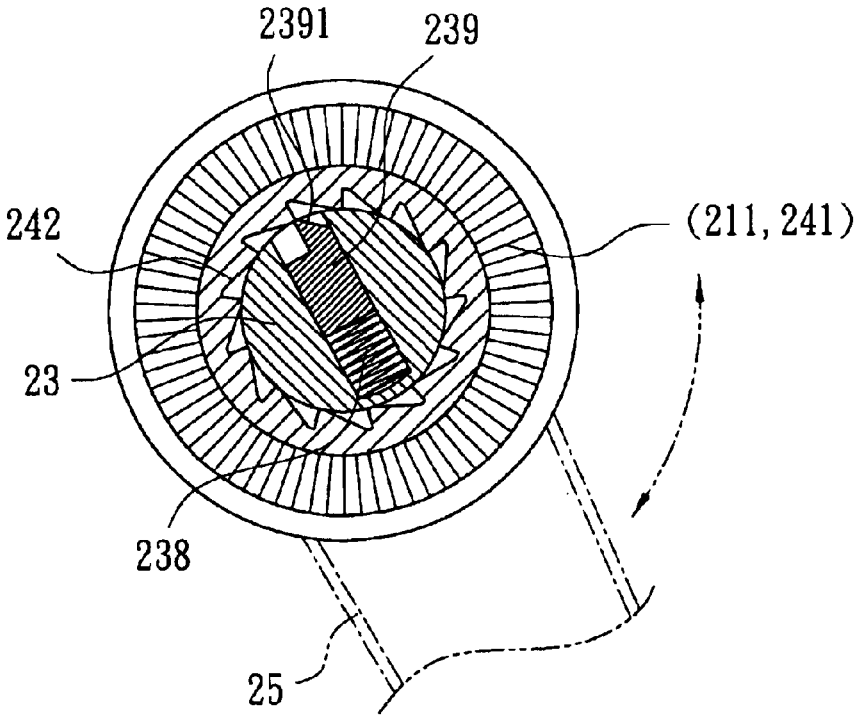
FIG. 4*a* is a cross sectional diagram, it is a sketch shows in the positioning pin and ratchet structure of the clutch mechanism, the movement of the key lock on the ratchet during the rotation of spooler.
Figure 5:
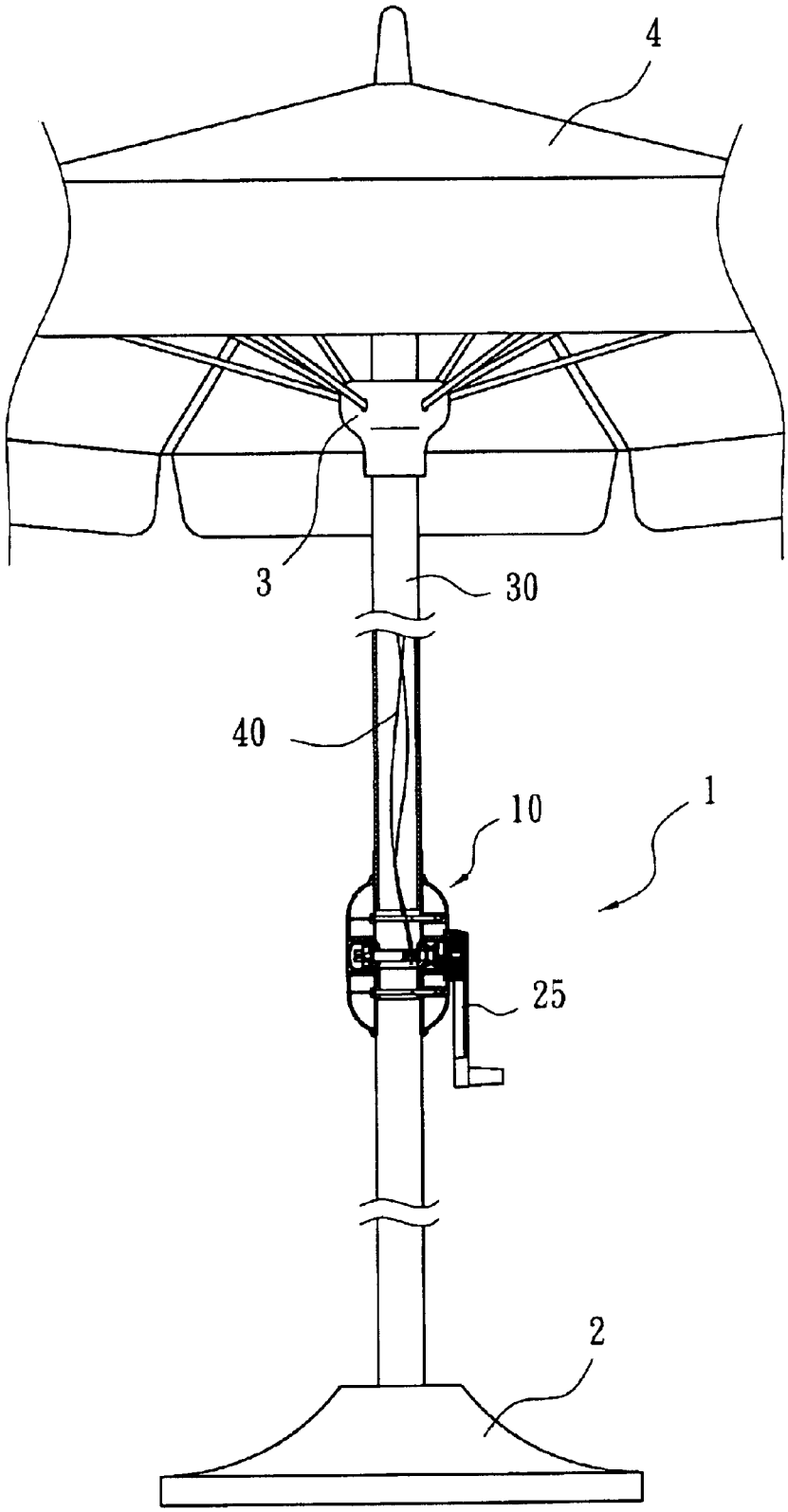
FIG. 5 is a sketch for a sample of this invention installed on an umbrella.
Figure 7:
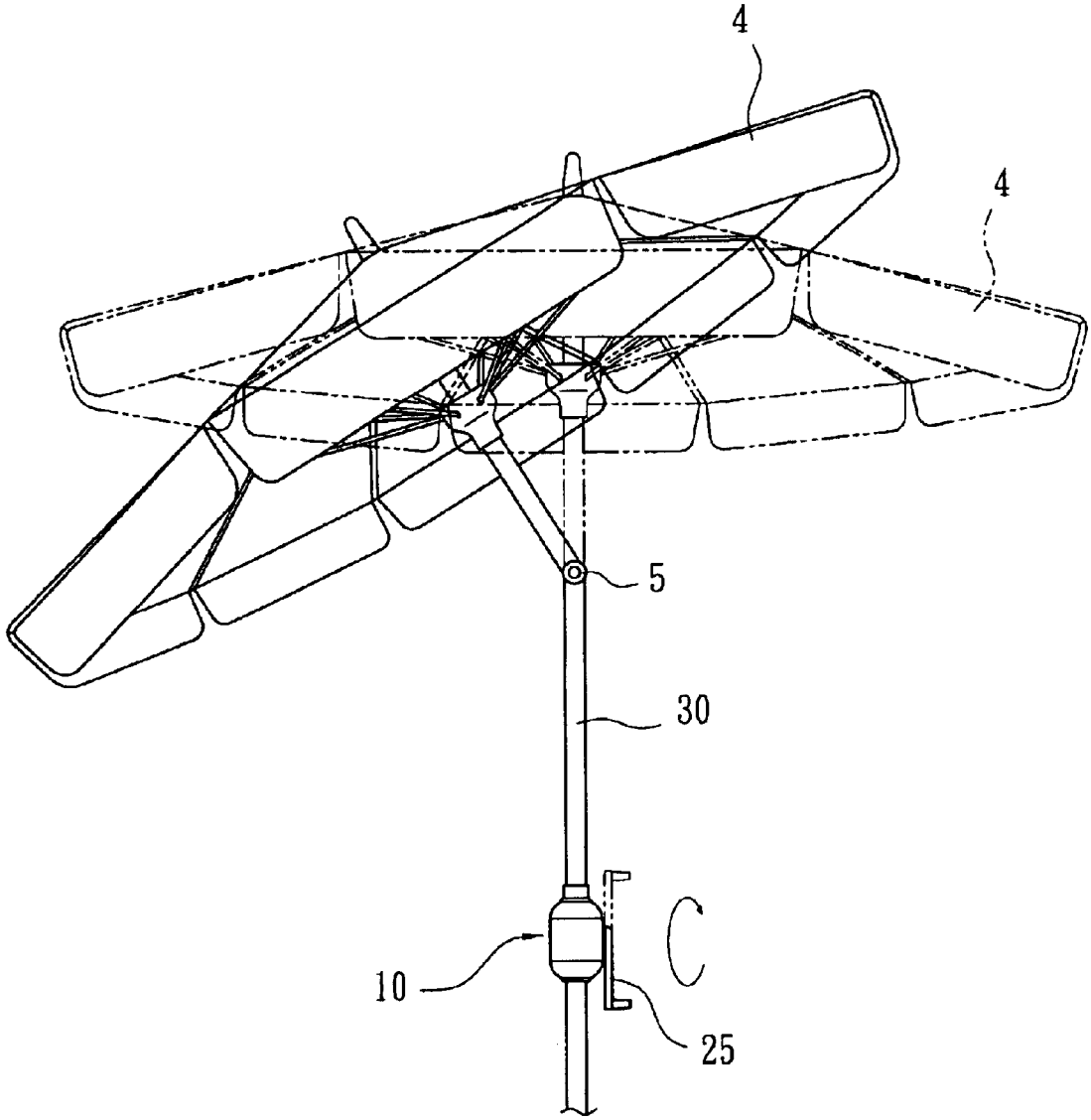
FIG. 7 is a sketch for the sample umbrella of this invention to change angle.
Figure 8:
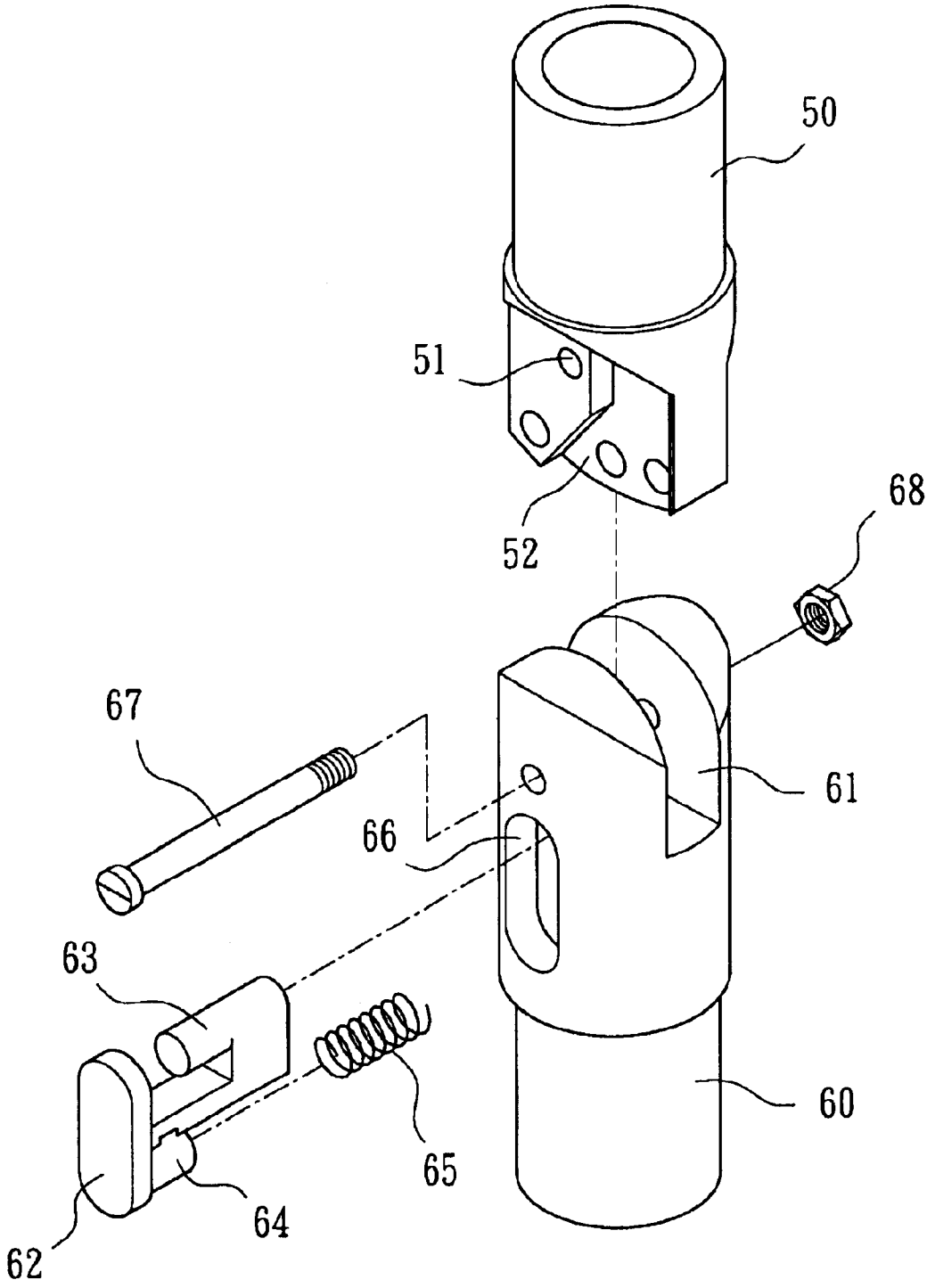
FIG. 8 is the sectional diagram for a traditional umbrella post folding mechanism.

Please refer to FIGS. 3 and 4. The major feature of this invention is that there is a clutch mechanism in the internal structure. It is formed by the clutch axle box 23 and key pin 239 and spring 238 on the spooler 23. Through the internal screw thread of the central opening 251 of the handle 25, it is combined with the front screw thread section 231 of the spooler 23. It is used to move left and right to achieve the self-lock performance, as the umbrella opened or shade angled In the following, the local cross sectional views in conjunction with the step-by-step operation procedure description are used to explain in details the features of this invention:

Please refer to FIGS. 3 and 4, when carrying on with the umbrella opening procedure, rotate the handgrip 25 in clockwise direction (when facing hand grip). When the handgrip 25 rotates to the bottom location (left limits on the drawing), the spooler 23 will connect to the handgrip, through the front-end screw thread section 231. Handgrip 23 will push clutch axle box 24. It will make the outside positioning thread 241 of the clutch axle box and front cover 20, the opening 21, and the side thread 211 joint together. The clutch axle box is in static status. The key pin 239 on the spooler 23 will be pushed by spring 238. It will make the thread of the key lock 239 fit joint into the ratchet part 242 (as shown in FIG. 4). When rotating the handgrip 25, it then fits to the bottom of the front-end screw teeth section 231 of the spooler 23, through the handgrip screw. The result is that the rotating axis 23 tightens rope 40 (refer to FIG. 5) to achieve the winding and umbrella opening purposes. During winding, the key lock 239 thread will move on the thread 242. When the umbrella 4 opened completely, continue rotation of the handgrip 25 will force the flexible folding mechanism 5 to form an angle. (As shown in FIG. 7).

The self-locking principle of this invention is that, after the above operation is completed, the umbrella is under normal operation condition and maintains complete self-lock safety performance. Any outside force exert to the umbrella and support will not lead to the danger of umbrella slip down or return. The reason is that, the thread grip of the key pin 239 fits thread part 242 (as shown in FIG. 4). The clutch axis 24 cover is pressed by the handgrip 25. It will make the outside positioning thread 241 of the clutch axle box and front cover 20, the opening 21, and the side thread 211 all joint into static status. The spooler will then self-locked.

Therefore, his invention will make use of the rotation of the handgrip 25 in clockwise direction to wind umbrella and achieve the rotation and angling effect.

Figure 6:
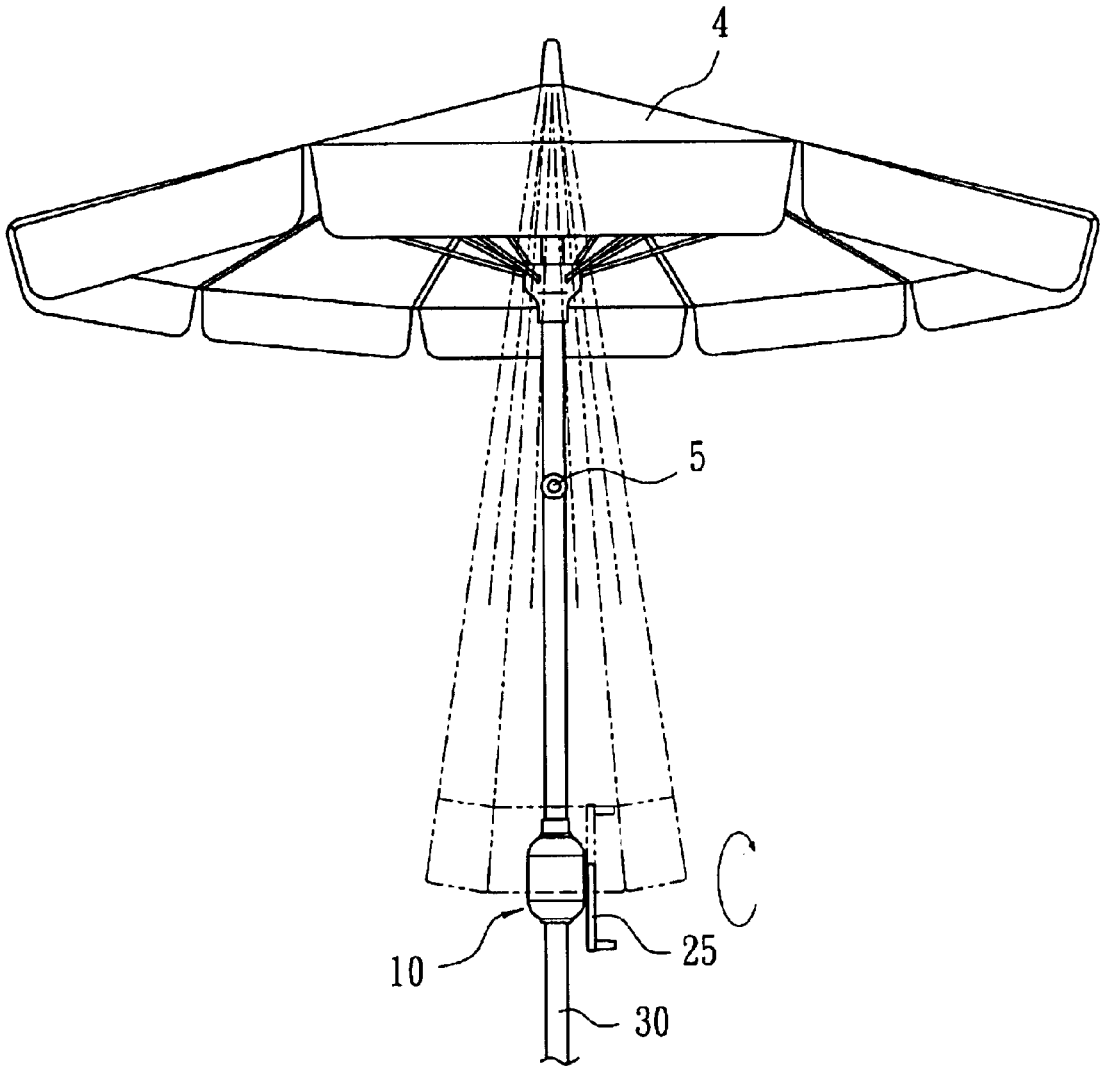
FIG. 6 is a sketch for the sample umbrella of this invention open and close.

Refer to FIG. 3. When return the umbrella and close the umbrella, the operation procedure is still simple. Reverse rotation of the handgrip, counter clock wisely rotates the handgrip. At this time, the handgrip 23 follows thread section 231 and reverse rotates to the bottom (right limit on the drawing). The handgrip is far away from the clutch axle box 24. The clutch axle box is then pushed by the spring 27. It will spring toward the right positions on the drawing. It will make the outside positioning thread 241 of the clutch axle box and front cover 20, the opening 21, and side teeth 211 all separate. Therefore the clutch axle box can be rotated and release from self-lock. Continue with counter-clock wisely rotate the handgrip 25; the rope 40 can be recovered to achieve umbrella-closing function (as shown in FIG. 6).

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An umbrella self lock mechanism comprising a winding mechanism and a clutch mechanism, wherein the winding mechanism has a spooler, a handgrip, and a rope through hole on the spooler to provide tightening of a pass through rope, with one end tightened on an umbrella tough, rotation of the handgrip winding the rope and open the umbrella, the clutch mechanism has a front cover to be fixed on an umbrella rod, openings on the front cover, through which to enter into opening on the umbrella rod, the clutch mechanism has a clutch which has an internal ring with threads, the ring has positioning threads engaged with threads of the front cover, the handgrip in the spooler is moved to push and pull a clutch axle box, the spooler has a stop ring with screw thread section at a front and end section, a flexible key pin on the stop ring, whereby after the spooler passes through an opening on an umbrella post and the opening on the front cover, the spring, clutch axle box, and bolted hand grip are fitted with an opening of the spooler through a front cover opening end axis screw thread section, thereby tightening the bolt at the spooler end to prevent the handgrip from falling out, and under normal conditions, the thread of the clutch axle box is fitted with the flexible key pin, and turning the handgrip will push clutch axle box to join with the front cover thus preventing rotation of the spooler and achieving self lock performance.

2. The umbrella self lock mechanism as claimed in claim 1, further comprising a rear cover with an opening, so that after the spooler passes through the umbrella post at the end of the screw thread section, a washer, a movement stop washer, and anti loose nuts are installed to fix the rear cover thereby making the spooler have a torque after having rotated for an angle.

3. The umbrella self lock mechanism as claimed in claim 1, wherein a cover is engaged with outer side of the opening on the rear cover for protecting and achieving appealing appearance.

4. The umbrella self lock operation mechanism as claimed in claim 1 wherein a folding mechanism is installed on the umbrella post for opening the umbrella, wind the umbrella and adjust the angle of the umbrella.

5. The umbrella self lock operation mechanism as claimed in claim 1, wherein a screw thread side of a head end of the spooler has milled surface for engaging with a stop washer and is associated with a sink head screw to engage with a threaded hole at the axis end bolt.

6. The umbrella self lock operation mechanism as claimed in claim 1, wherein a screw teeth side of a tail end of the spooler has milled trough for engaging with the washer and stop washer, and the hole at the center of the washer and stop washer are used to join with the mill trough at the tail end of the spooler and finally tightened with an anti loose nut thereby achieving a rotation function with damping effect.

* * * * *